United States Patent [19]

Sekiya et al.

[11] 4,257,114

[45] Mar. 17, 1981

[54] ELECTRONIC TIMEPIECE

[75] Inventors: Fukuo Sekiya; Yuzo Maekawa, both of Tokorozawa, Japan

[73] Assignee: Citizen Watch Co., Ltd., Tokyo, Japan

[21] Appl. No.: 10,350

[22] Filed: Feb. 8, 1979

[30] Foreign Application Priority Data

Feb. 16, 1978 [JP] Japan ..... 53/125603
Oct. 12, 1978 [JP] Japan ..... 53/16897

[51] Int. Cl.[3] ..... G04G 5/04
[52] U.S. Cl. ..... 368/62; 368/188
[58] Field of Search ..... 58/4 A, 23 R, 38 R, 58/38 A, 39, 39.5, 50 R, 50 A, 57.5, 58, 85.5; 368/34, 185, 187, 188, 201, 62

[56] References Cited

U.S. PATENT DOCUMENTS 4,043,111 8/1977 Fujita ..... 58/85.5
4,095,405 6/1978 Tanaka ..... 58/85.5

*Primary Examiner*—Edith S. Jackmon
*Attorney, Agent, or Firm*—Jordan and Hamburg

[57] ABSTRACT

An electronic timepiece having a rotatable operating member such as a crown, with switch and pulse generation means coupled to the operating member whereby a number of pulses can be produced each time the operating member is rotated, these pulses being used to modify time information displayed by the timepiece.

11 Claims, 12 Drawing Figures

ELECTRONIC TIMEPIECE

This invention relates to a method of producing pulses for correcting the time information displayed by an electronic timepiece, by operating a rotatable external operating member such as a timepiece crown.

In a conventional type of electronic timepiece, pushbutton type switches are normally employed for such purposes as correcting the displayed time information, setting a desired alarm time, etc. Various circuits are known whereby the effects of spurious pulses produced by contact bounce in such pushbutton type switches can be eliminated. However, mechanical timepieces have traditionally been equipped with a crown, which is rotated by the timepiece user in order to correct the displayed time information. In the case of certain electronic timepieces, it is desirable therefore to provide a rotatable external operating member such as a crown for time correction purposes. The use of a crown for such a purpose, however, presents a problem in that, if the crown is coupled to switch means for producing operating pulses as the crown is rotated, the maximum frequency at which such operating pulses may be produced is considerably higher than can be expected in the case of a pushbutton type switch. For this reason, the type of circuit which is usually employed to eliminate the effects of contact bounce in the case of a pushbutton type switch is unsuitable for a switch which is actuated by rotation of a crown.

With the method of the present invention, the difficulty described above is overcome, by providing simple and effective circuit means whereby a number of pulses can be produced by each rotation of a crown, with the effects of contact bounce being eliminated.

It is therefore an object of the present invention to provide an improved signal generator for an electronic timepiece in which correction of time information is performed by actuation of a rotatable external operating member such as a timepiece crown.

Further objects, features and advantages of the present invention will be made more apparent from the following description, when taken in conjunction with the attached drawings, whose scope is given by the appended claims.

Figure 1A:
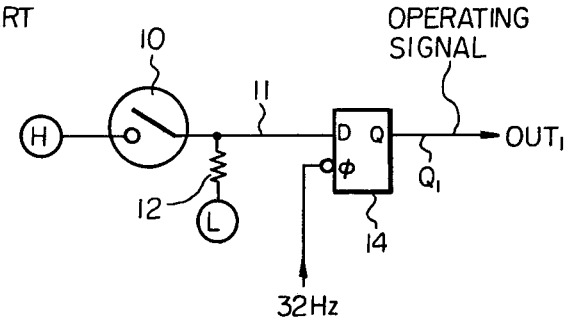
Fig. 1A PRIOR ART
FIGS. 1A, 1B and 1C illustrate a conventional type of pushbutton switch used in an electronic timepiece, and circuits for eliminating the effects of contact bounce.
Figure 2:
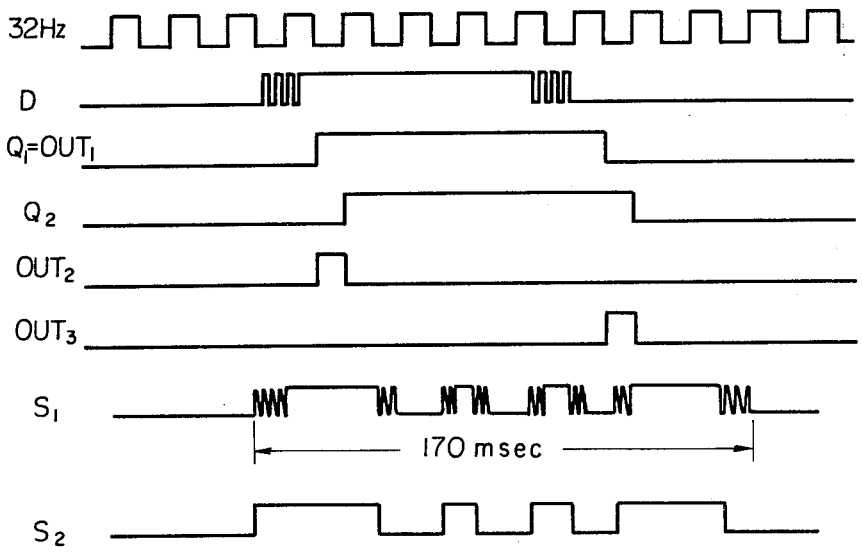
FIG. 2 is a waveform diagram illustrating waveforms of the circuits of FIGS. 1A to 1C.

Referring now to the figures, FIG. 1A shows a pushbutton switch 10 used to produce operating pulses in an electronic timepiece, for time correction or other purposes. The output of switch 10, appearing on line 11, is normally held at a low logic level potential (referred to hereinafter as the L level), by being connected to the L level through resistor 12. When switch 10 is actuated, then output line 11 goes to the high logic level potential (referred to hereinafter as the H level). Thus, actuation and then release of pushbutton switch 10 causes a signal D to be produced, having the waveform shown in the waveform diagram of FIG. 2. As shown in FIG. 2, spurious pulses are produced when switch 10 is actuated and released, due to the effects of switch bounce. Data-type flip-flop 14 is used to eliminate the spurious pulses. Output line 11 of switch 10 is coupled to the data input terminal of flip-flop 14, while a clock signal having a suitable frequency, which is 32 Hz in the examples shown in FIG. 1A, is applied to the clock input terminal of flip-flop 14. Since the period of the 32 Hz clock signal is greater than the maximum possible duration of the group of spurious pulses produced each time switch 10 is actuated or released, a single transition from the L level to the H level will occur at the Q output terminal of flip-flop 14 after switch 10 has been actuated. Similarly, a single transition from the H level to the L level will occur at the Q output terminal of flip-flop 14 after switch 14 has been released. Thus, a single pulse of long duration is produced each time switch 10 is actuated. This is designated as $OUT_1$ in FIG. 1A and FIG. 2.

Figure 1B:
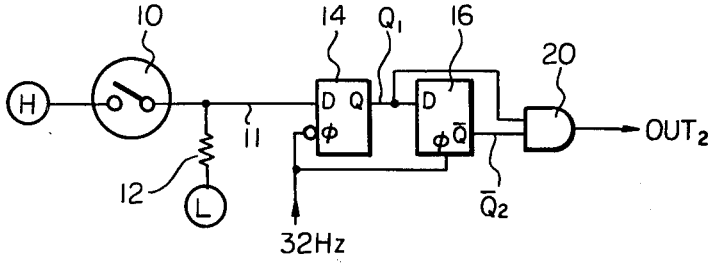
Fig. 1B PRIOR ART

FIG. 1B illustrates a method whereby a single pulse of standard duration is produced each time switch 10 is actuated. In this case, the Q output of flip-flop 14 is coupled to the data input terminal of a second data-type flip-flop 16, and the 32 Hz clock signal is applied to the clock input terminal of flip-flop 16 and inverted and applied to the clock input terminal of flip-flop 14. The Q output of flip-flop 14 and the Q output of flip-flop 16 are applied to inputs of an AND gate 20. The Q output of flip-flop 14, designated as $Q_1$ in FIG. 1B, goes to the H level on the trailing edge of a 32 Hz clock pulse after switch 10 has been actuated, while the Q output of flip-flop 16, designated as $Q_2$ in FIG. 2, goes to the H level on the next leading edge of the 32 Hz signal. Thus, the output of AND gate 20 consists of a single pulse which is produced when both the Q output of flip-flop 14 and the $\overline{Q}$ output of flip-flop 16 are both at the H level. It is apparent that this will only occur for a time duration of one half period of the 32 Hz signal, after switch 10 has been actuated. This output pulse is designated as $OUT_2$ in FIG. 2. Since the duration of this pulse is determined by the frequency of the 32 Hz clock signal, it is independent of the duration for which switch 10 is actuated.

Figure 1C:
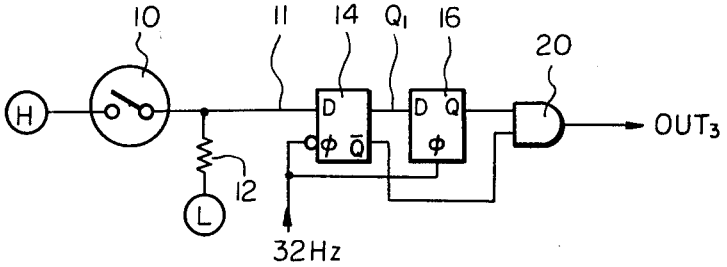
Fig. 1C PRIOR ART

Referring now to FIG. 1C, a method is shown whereby a single pulse is produced each time switch 10 is released after having been actuated. In this case, the only difference from the circuit of FIG. 1B is that the Q output of flip-flop 16 and the $\overline{Q}$ output of flip-flop 14 are connected to the input terminals of AND gate 20. A single pulse is thus generated by AND gate 20 when both of these flip-flop outputs are simultaneously at the H level, a condition which occurs only for one half period of the 32 Hz signal after switch 10 has been released. The single output pulse produced by each actuation of switch 10 for the circuit of FIG. 1C is designated as $OUT_3$ in FIG. 2.

Figure 3:
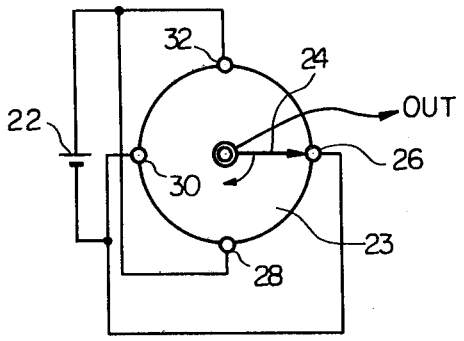
FIG. 3 is a circuit diagram of switch means suitable for coupling to the crown of an electronic timepiece.

Referring now to FIG. 3, a circuit diagram is shown therein of switch means suitable for coupling to an externally actuated rotatable member, such as a crown, of an electronic timepiece. The H level potential of the timepiece battery 22 is connected to switch contacts 28 and 32, while the L level potential of the battery is connected to switch contacts 26 and 30. A rotating contact 24 is mechanically coupled to the timepiece crown, so that each time the crown is rotated through one revolution, rotating contact 24 produces an output signal having four transitions between the H and the L levels. The waveform of the output signal produced by a switch such as that of FIG. 3 is shown as $S_1$ in FIG. 2. As can be seen, when the timepiece crown is rotated rapidly, pulses are produced which are of the same order of pulse width as the 32 Hz clock signal used in the circuits of FIGS. 1A to 1C. Thus, some of the pulses in signal $S_1$ may not be detected by a circuit such as those of FIGS. 1A to 1C.

If it is attempted to remedy this situation by utilizing a clock signal of higher frequency than 32 Hz, however, there is a danger that two or more output pulses may be produced each time switch contact is made or broken, since the period of the clock signal pulses will become comparable to the period of the spurious pulses produced by contact bounce. Thus, a circuit such as that of FIGS. 1A, 1B, or 1C is not suitable for use with a rotatable crown coupled to switch means for producing an operating signal.

Figure 4:
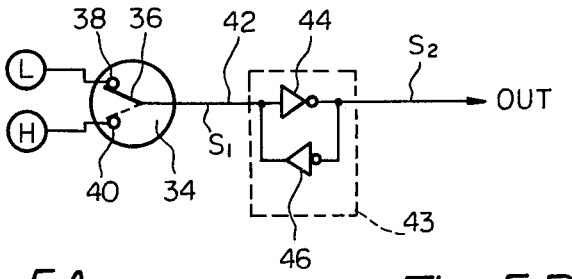
FIG. 4 is a circuit diagram of a latch circuit for eliminating the effects of contact bounce in accordance with the present invention.

Referring now to FIG. 4, a signal generator in accordance with the present invention is shown which is suitable for eliminating the effects of switch bounce in the output signal from a switch in which contact is made and broken in rapid succession, such as that shown in FIG. 3. Numeral 34 indicates a switch which is actuated by the rotation of a timepiece crown. Movable contact 36 is alternately coupled to contact 38, to produce an output at the L level, and to contact 40 to produce an output at the H level, thereby producing an operating signal $S_1$ as shown in FIG. 2. Signal $S_1$ is applied to a latch type bistable circuit 44, composed of two inverters 44 and 46, with the output of 44 being connected to the input of 46, and the output of 46 being connected to the input of 44. As compared with the circuits of FIGS. 1A to 1C, output line 42 which connects switch 34 to the input of latch circuit 43 is not held at a fixed potential when movable contact 36 breaks contact with contacts 38 and 40. Instead, the potential of output line 42 is determined by the output level of inverter 43, in such a case. Thus, each time movable contact 36 touches either contact 38 or 40, the logic level of the contact concerned is memorized by latch circuit 43. Thus, any subsequent momentary loss of contact due to switch bounce will have no effect upon the latch output signal from the latch circuit 43. This latch output signal is designated as $S_2$ in the waveform diagram of FIG. 2, and as is shown, this signal is free from the effects of contact bounce.

Figure 5A:
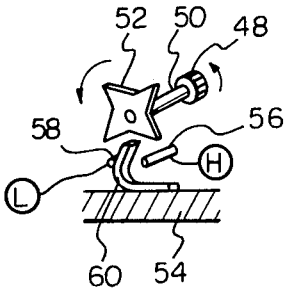
FIGS. 5A and 5B illustrate an embodiment of switch means according to the present invention coupled to the crown of an electronic timepiece.
Figure 5B:
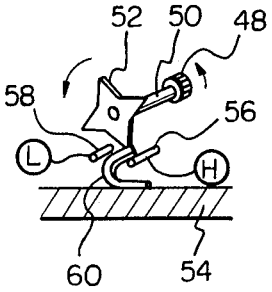

FIG. 5A and FIG. 5B illustrate an embodiment of switch means coupled to a timepiece crown, for use in an electronic timepiece according to the present invention. Numeral 48 indicates a crown, which is fixed to a stem 50. A gear 52 is fixed to one end of the winding stem 50. A movable contact 60 is made of resilient material, and is attached to a timepiece circuit substrate 54. Movable contact 60 is normally held in contact with a fixed contact 58 which is at the L level potential. As the crown 48 is rotated, movable contact 60 is forced into contact with the fixed contact 56, which is at the H level potential, as shown in FIG. 5B. As the crown 48 is rotated further, movable contact 60 is released, and springs back to touch fixed contact 58. This process is repeated four times for one revolution of the crown, so that a total of either transitions between the H and L levels occurs in the operating signal $S_1$ which is produced by movable contact 60, for each revolution of the crown 48.

Figure 6:
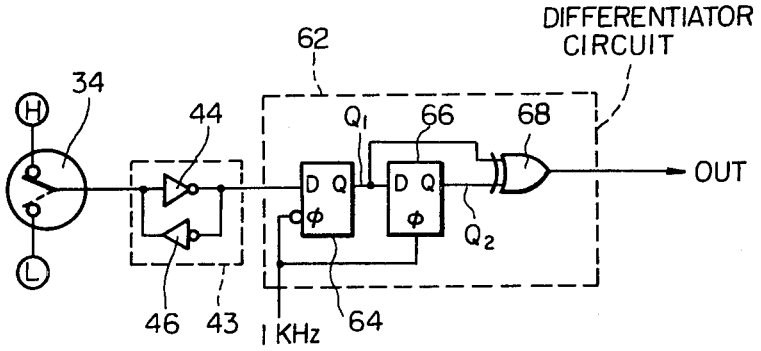
FIG. 6 is a circuit diagram of a latch circuit for eliminating the effects of contact bounce and a differentiator circuit for producing single pulses from the output signal of the latch circuit.
Figure 7:
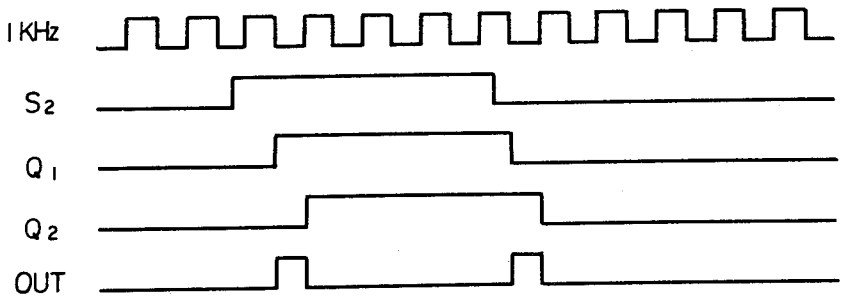
FIG. 7 is a waveform diagram of the circuit of FIG. 6.

FIG. 6 shows a circuit by which a single pulse of standard duration is produced each time a transition between the H and L levels occurs for signal $S_1$ produced by switch means such as that shown in FIGS. 5A and 5B. The waveforms of signals produced by the circuit of FIG. 6 are shown in the waveform diagram of FIG. 7. As described previously, a latch type bistable circuit 43 produces a signal $S_2$ in accordance with actuation of switch 34, with the effects of contact bounce being eliminated. Numeral 62 indicates a differentiator circuit, containing a first data-type flip-flop 64, which has a 1 kHz clock signal applied through an inverting input to its clock terminal, and a second data-type flip-flop 66 which has the 1 kHz clock signal applied directly to its clock input terminal. The output of latch circuit 43 is applied to the data terminal of flip-flop 64, while the Q output terminal of flip-flop 64 is applied to the data terminal of flip-flop 66 and to an input of an exclusive-OR gate 68. The Q output terminal of flip-flop 66 is connected to the other input of exclusive-OR gate 68. As shown in the waveform diagram of FIG. 7, when the latch output signal $S_2$ goes from the L level to the H level as the timepiece crown is rotated, the trailing edge of the next 1 kHz clock signal pulse to occur causes the state of the latch output signal to be memorized by flip-flop 64, so that the Q output of flip-flop 64, designated as $Q_1$, goes from the L level to the H level. The leading edge of the next 1 kHz clock signal pulse to occur after this causes the state of the $Q_1$ output to be memorized by flip-flop 66, so that the Q output of flip-flop 66 then goes to the H level. During the time between output $Q_1$ going to the H level and output $Q_2$ going to the H level, the inputs to exclusive-OR gate 68 are at different logic levels, so that the output of gate 68 goes to the H level during this time. In other words a pulse is output from exclusive-OR gate 68 which has a pulse width equal to one half period of the 1 kHz clock signal.

Similarly, output signals $Q_1$ and $Q_2$ are at different logic levels for a period of time equal to one half the period of the 1 kHz clock signal just after latch output signal $S_2$ goes to the L level from the H level. Thus, for each transition between the H and L logic levels, a short pulse of defined duration is generated by differentiator circuit 62.

If the circuit of FIG. 6 is used in an electronic timepiece in conjunction with a switch coupled to a crown such as the embodiment shown in FIG. 5A and 5B above, then it will be apparent that eight pulses are produced each time the crown is rotated through one revolution. If these pulses are input to the timekeeping circuit of the timepiece to correct the time information therein, then the timepiece user can easily control the rate at which time correction is performed, by either spinning the crown rapidly around, or rotating the crown slowly and gradually.

Figure 8:
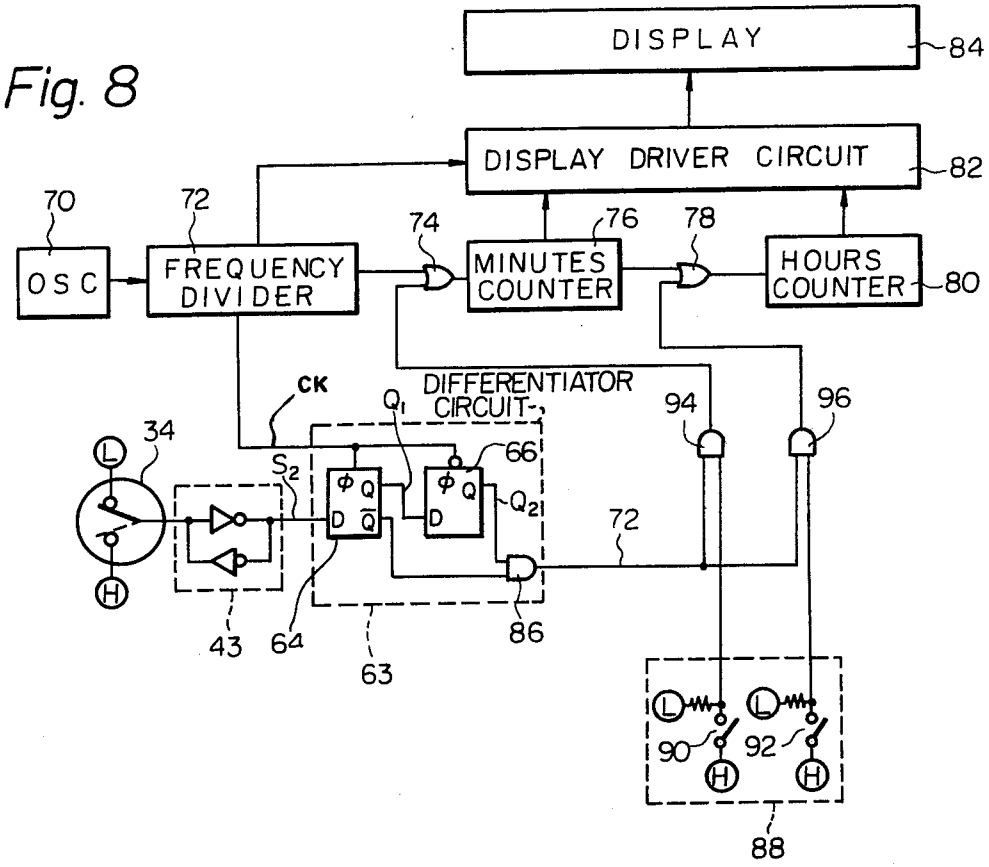
FIG. 8 is a block diagram of an electronic timepiece according to the present invention having means for selecting time information to be corrected and means for correcting the selected information by rotating a timepiece crown.

Referring now to FIG. 8, an embodiment of an electronic timepiece according to the present invention is shown therein in simplified block diagram form. Numeral 70 indicates a source of a standard frequency signal of relatively high frequency. The standard frequency signal is applied to a frequency divider 72, which produces a standard time signal having a period of one minute which is applied to a minutes counter 76 through an OR gate 74, and also produces a clock signal CK having a frequency of the order of 1 kHz. The minutes of time information are counted by counter 76, which produces a signal having a period of one hour, which is applied through an OR gate 78 to an hours counter circuit 80 in which the hours of time information are counted.

Figure 9:
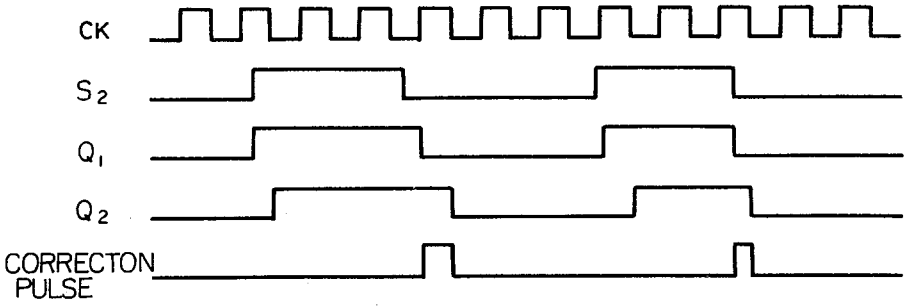
FIG. 9 is a waveform diagram illustrating waveforms of circuitry for producing time correction pulses in the timepiece of FIG. 8.

The contents of minutes counter 76 and hours counter 80 are applied to a display driver circuit 82, which drives a display device 84 to display the time information. Numeral 34 indicates switch means which is coupled to a rotatable external actuating member such as a crown, and which produces an operating signal which alternates between the H and the L logic levels as the crown is rotated. Numeral 43 is a latch circuit, which produces a latch output signal $S_2$ in response to the operating signal from switch 34. Numeral 63 indicates a differentiator circuit, including a first data-type flip-flop 64, a second data-type flip-flop 66, and an AND gate 86. As compared with the differentiator circuit of FIG. 6, described previously, the circuit of FIG. 8 produces a pulse only when the latch output signal $S_2$ goes from the H level to the L level, i.e. four pulses are produced for each revolution of the crown. Clock signal CK is applied directly to the clock input terminal of flip-flop 64, and is inverted and applied to the clock input of flip-flop 66. The $\overline{Q}$ output of flip-flop 64, designated as $Q_1$ in the waveform diagram of FIG. 9, and the Q output of flip-flop 66, designated as $Q_2$ in FIG. 9, are applied to inputs of an AND gate 86. AND gate 86 produces an output pulse having a duration of one half period of clock signal CK, which occurs when output $Q_1$ is at the L level and output $Q_2$ is at the H level, i.e. immediately after the latch output signal $S_2$ goes from the H level to the L level.

Numeral 88 indicates a correction selector switch circuit, which is used to select the time information to be corrected. The outputs of switches 90 and 92 are normally held at the L logic level. When switch 90 is actuated, an H level signal is applied to an input of AND gate 94, thereby selecting the minutes of time information for correction. If the crown of the timepiece is now rotated, output pulses will be produced by differentiator circuit 63, and applied through AND gate 94 and OR gate 74 to the input terminal of minutes counter 76. The timepiece user can thus correct the minutes of the time information displayed by the timepiece.

Similarly, if switch 92 is actuated, an H level input will be applied from this switch to an input of AND gate 96, causing the hours of time information to be selected for correction. If the timepiece user now rotates the timepiece crown, the displayed hours information can be corrected to a desired value.

It is of course equally possible to utilize the differentiator circuit shown in FIG. 6 to a timepiece circuit such as that shown in FIG. 8, if desired.

From the foregoing description, it will be apparent that the concept of the present invention enables reliable detection of an operating signal from a switch which consists of short duration pulses accompanied by spurious pulses caused by contact bounce. The effects of contact bounce are suppressed by means of the latch circuit connected to the switch output. So long as the duration of the output pulses from the latch circuit is greater than approximately one half period of the clock signal applied to the differentiator circuit, then these latch output pulses will be reliably detected by the differentiator cirucit, and short duration pulses of predetermined pulse width will be produced by the differentiator circuit in response to the latch output pulses. The short duration pulses of an operating signal produced when a crown attached to switch means is rapidly rotated can therefore be effectively utilized for time information correction in an electronic timepiece according to the present invention.

Although the present invention has been shown and described herein with respect to various embodiments, it should be noted that various changes and modifications to these embodiments are possible which fall within the scope claimed for the present invention.

What is claimed is:

1. In an electronic timepiece powered by a battery, having a source of a standard frequency signal, a frequency divider responsive to an output signal of said source of a standard frequency signal to provide a high frequency signal pulse and a low frequency signal pulse, timekeeping means responsive to said low frequency signal pulse for producing time information, display means for displaying said time information, and externally actuated pulse generation means for generating signal pulses to be applied to said timekeeping means for modifying said time information, the improvement comprising:

a rotatable external operating member comprising a timepiece crown;

switch means coupled to said rotatable external operating member for producing an operating signal alternating between a first logic level potential and a second logic level potential in response to actuation of said rotatable external operating member;

a latch circuit for memorizing successive logic level potential transitions of said operating signal from said switch means to produce a latch output signal; and circuit means for producing output pulses each having a pulse width of less than 0.03 seconds in response to logic level potential transitions of said latch output signal and said high frequency signal pulse from said frequency divider;

said switch means comprising a first fixed contact member connected to a first logic level potential, a second fixed contact member connected to a second logic level, and movable contact member coupled to said rotatable external actuating member such as to be alternately set in contact with said first fixed contact member and said second fixed contact member in response to rotation of said rotatable external actuating member;

said latch circuit being responsive to actuation of said movable contact member relative to one of said first fixed contact member and said second fixed contact member, to change its stored content.

2. The improvement according to claim 1, wherein said latch circuit comprises a first inverter circuit and a second inverter circuit, with an output terminal of said first inverter circuit being connected to an input terminal of said second inverter circuit and with an output terminal of said second inverter circuit being connected to an input terminal of said first inverter circuit.

3. The improvement according to claim 1, wherein said circuit means is responsive to each transition of said latch output signal from a first logic level potential to a second logic level potential to produce an output pulse.

4. The improvement according to claim 3, wherein said circuit means comprises a first data-type flip-flop, second data-type flip-flop, inverter means coupled to a clock input terminal of said second data type flip-flop, and AND gate means coupled to output terminals of said first and second data-type flip-flops, and wherein said high frequency signal pulse from said frequency divider is applied to a clock input terminal of said first data-type flip-flop and to an input terminal of said inverter means, said latch output signal from said latch circuit being applied to a data input terminal of said first data-type flip-flop and an output terminal of said first flip-flop being coupled to a data input terminal of said second data-type flip-flop, whereby said output pulse is produced by said AND gate means in response to said each transition of said latch output signal from the first logic level potential to the second logic level potential.

5. The improvement according to claim 1, and further comprising time correction circuit means responsive to said output pulse from said circuit means and said signal pulses from said externally actuated pulse generation means to selectively correct stored contents of said timekeeping means.

6. In an electronic timepiece powered by a battery, having a source of a standard frequency signal, a frequency divider responsive to an output signal of said source of a standard frequency signal to provide a high frequency signal pulse and a low frequency signal pulse, timekeeping means responsive to said low frequency signal pulse for producing time information, display means for displaying said time information, and externally actuated pulse generation means for generating signal pulses to be applied to said timekeeping means for modifying said time information, the improvement comprising: a rotatable external operating member;

switch means coupled to said rotatable external operating member for producing an operating signal alternating between a first logic level potential and a second logic level potential in response to actuation of said rotatable external operating member;

a latch circuit for memorizing successive logic level potential transitions of said operating signal from said switch means to produce a latch output signal; and circuit means for producing output pulses in response to each transition of said latch output signal from a first logic level potential to a second logic level potential and from said second logic level potential to said first logic level potential and said high frequency signal pulse from said frequency divider;

said switch means comprising a first fixed contact member connected to a first logic level potential, a second fixed contact member connected to a second logic level, and movable contact member coupled to said rotatable external actuating member such as to be alternately set in contact with said first fixed contact member and said second fixed contact member in response to rotation of said rotatable external actuating member;

said latch circuit being responsive to actuation of said movable contact member relative to one of said first fixed contact member and said second fixed contact member, to change its stored content.

7. The improvement according to claim 6, wherein said circuit means comprises a first data-type flip-flop, a second data-type flip-flop, inverter means coupled to a clock input terminal of said first data-type flip-flop, exclusive-OR gate means having input terminals coupled to output terminals of said first and second data-type flip-flops, and wherein said high frequency signal pulse from said timekeeping circuit means is applied to a clock input terminal of said second data-type flip-flop and to an input terminal of said inverter means, said latch output signal from said latch circuit being applied to a data input terminal of said first data-type flip-flop and an output terminal of said first data-type flip-flop being coupled to a data input terminal of said second data-type flip-flop, whereby said output pulses are produced by said exclusive-OR gate means in response to said each transition of said latch output signal from the first logic level potential to the second logic level potential and from said second logic level potential to said first logic level potential.

8. The improvement according to claim 6, wherein each of said output pulses from said circuit means has a pulse width of less than 0.03 seconds.

9. The improvement according to claim 6, wherein said rotatable external operating member comprises a timepiece crown.

10. The improvement according to claim 6, wherein said latch circuit comprises a first inverter circuit and a second inverter circuit, with an output terminal of said first inverter circuit being connected to an input terminal of said second inverter circuit and with an output terminal of said second inverter circuit being connected to an input terminal of said first inverter circuit.

11. The improvement according to claim 6, and further comprising time correction circuit means responsive to said output pulses from said circuit means and said signal pulses from said externally actuated pulse generation means to selectively correct stored contents of said timekeeping means.

* * * * *